US008269753B2

(12) United States Patent
Matsuki

(10) Patent No.: US 8,269,753 B2
(45) Date of Patent: Sep. 18, 2012

(54) DISPLAY DEVICE AND ELECTRONIC MACHINE HAVING THE SAME

(75) Inventor: Fumirou Matsuki, Kobe (JP)

(73) Assignee: Chimei Innolux Corporation, Chu-Nan (TW)

( * ) Notice: Subject to any disclaimer, the term of this patent is extended or adjusted under 35 U.S.C. 154(b) by 265 days.

(21) Appl. No.: 12/702,224

(22) Filed: Feb. 8, 2010

(65) Prior Publication Data

US 2010/0201277 A1 Aug. 12, 2010

(30) Foreign Application Priority Data

Feb. 9, 2009 (JP) ..... 2009-027195

(51) Int. Cl.
*G09G 5/00* (2006.01)
*H05B 37/02* (2006.01)

(52) U.S. Cl. ..... 345/207; 345/102; 345/211; 315/158

(58) Field of Classification Search ..... 345/66, 345/82, 99, 102, 204, 207, 211; 315/158, 315/307

See application file for complete search history.

(56) References Cited

U.S. PATENT DOCUMENTS

| | | | | |
|---|---|---|---|---|
| 8,081,176 | B2 * | 12/2011 | Han et al. | 345/207 |
| 2005/0275616 | A1 * | 12/2005 | Park et al. | 345/102 |
| 2008/0001909 | A1 * | 1/2008 | Lim | 345/102 |
| 2008/0073490 | A1 * | 3/2008 | Koide | 250/214 |
| 2008/0079860 | A1 * | 4/2008 | Kunimori et al. | 349/43 |
| 2008/0158211 | A1 * | 7/2008 | Kwon | 345/207 |

* cited by examiner

*Primary Examiner* — Tung X Le
(74) *Attorney, Agent, or Firm* — Liu & Liu

(57) ABSTRACT

A display device capable of detecting the light intensity of ambient light with high accuracy is disclosed. The display device has a backlight light source and a photo sensing unit. The display device also includes a voltage supply unit for providing a voltage, which makes the photo sensing unit output a certain amount of photocurrent to the photo sensing unit; and a supply voltage control unit for modulating the voltage supplied to the photo sensing unit based on the operation status of the backlight light source. The supply voltage control unit controls the voltage supply unit by the way of outputting a voltage of a first voltage to the photo sensing unit while the backlight light source is operating; and outputting a voltage of a second voltage, which is different from the first voltage, to the photo sensing unit while the backlight light source is not operating.

20 Claims, 5 Drawing Sheets

DISPLAY DEVICE AND ELECTRONIC MACHINE HAVING THE SAME

BACKGROUND OF THE INVENTION

1. Field of the Invention

The present invention relates to a display device and an electronic machine having the display device. The display device has a backlight light source and a photo sensing unit capable of detecting the light intensity of ambient light and outputting a photocurrent corresponding to the light intensity of ambient light.

2. Description of Related Art

In recent years, display devices, such as those commonly applied in mobile navigation devices, cell phones, etc, have been capable of allowing the display brightness to be modified corresponding to the intensity of ambient light. For example, the system disclosed in the Japan Publication Patent No. 2001-522058, which disclosed a controller for controlling the display brightness of the display device, bases on the result of light intensity of ambient light detected by the photo sensing unit. By having this controller, the system can increase the display brightness of the display device at an outdoor place with bright sunlight, and decrease the display brightness of the display device at an indoor place, where the ambient light is weak.

In general, the display device has a photo sensing unit, which outputs a photocurrent based on the detection result on the light intensity of ambient light. Later, by means of a current-voltage transformer or an analog-digital transformer, the photocurrent is transformed into a voltage or digital pulse signal, being output to a controller controlling the operation status of the backlight light source. The controller then modulates the light intensity of the backlight light source of the display device based on the input voltage or digital pulse signal. A circuit used for the aforementioned light intensity detection is disclosed in the Japan Publication Patent No. 2008-522159.

SUMMARY OF THE INVENTION

However, the display device having the aforementioned circuit has the drawback that the detection of the light intensity of ambient light is affected by the light emitted by the backlight light source. Therefore, the objective of the present invention is to provide a display device capable of detecting the light intensity of ambient light with high accuracy and an electronic device having the display device.

To achieve the object, the display device of the present invention has a backlight light source and a photo sensing unit capable of detecting the light intensity of ambient light and outputting a photocurrent corresponding to the light intensity of ambient light. The display device comprises a voltage supply unit for providing a voltage, which makes the photo sensing unit output a certain amount of photocurrent, to the photo sensing unit; and a supply voltage control unit for controlling the voltage supply unit by the way of modulating the voltage supplied to the photo sensing unit based on the operation status of the backlight light source. The supply voltage control unit outputs a voltage of a first voltage to the photo sensing unit while the backlight light source is operating; and outputs a voltage of a second voltage, which is different from the first voltage, to the photo sensing unit while the backlight light source is not operating.

Therefore, by changing the voltage, which makes the photo sensing unit output a certain amount of photocurrent, it is possible for the display device of the present invention to detect the light intensity of ambient light with high accuracy In one embodiment of the present invention, the voltage of the second voltage makes the photo sensing unit output a photocurrent with maximum value, while the voltage of the first voltage makes the photo sensing unit output a photocurrent with the value smaller than the maximum value.

As a result, the error Ierror, which existed in the photocurrent detection result can be decreased, and can even be removed completely.

In one embodiment of the present invention, the photo sensing unit is a low-temperature poly-silicon lateral-type PIN photodiode or an amorphous diode.

In one embodiment of the present invention, the display device is a transparent type or transflective type liquid crystal display having a backlight light source.

The display device according to one embodiment of the present invention can be applied in a laptop PC, a cell phone, a personal digital assistant, a mobile navigation device, a portable game station, and so on, which can detect the light intensity of ambient light.

The present invention can provide a display device and an electronic machine having the display device, wherein the display device is capable of detecting the light intensity of ambient light with high accuracy.

DETAILED DESCRIPTION OF THE PREFERRED EMBODIMENT

With reference to the figures of the present invention, the best mode of the present invention is disclosed hereinafter.

Figure 1:
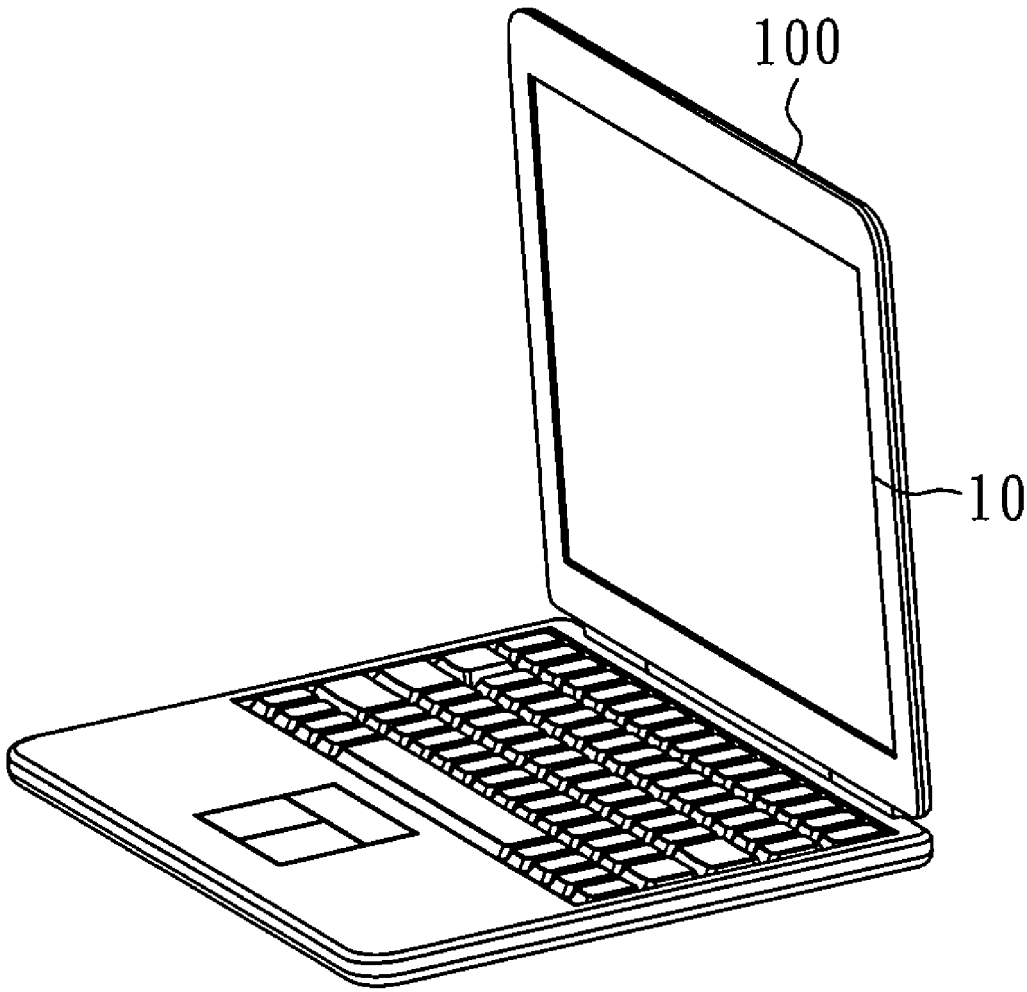
FIG. 1 is a diagram illustrated the electronic device having the display device according to the embodiment of the invention.

FIG. 1 is a diagram illustrated the electronic device having the display device according to the embodiment of the invention.

Although the electronic device 100 shown in FIG. 1 is in the form of a laptop PC, the electronic device 100 can be a cell phone, a personal digital assistant, a mobile navigation device, a portable game station, and so on. The electronic device 100 has a display device 10, wherein the display device includes a display module for displaying images.

Figure 2:
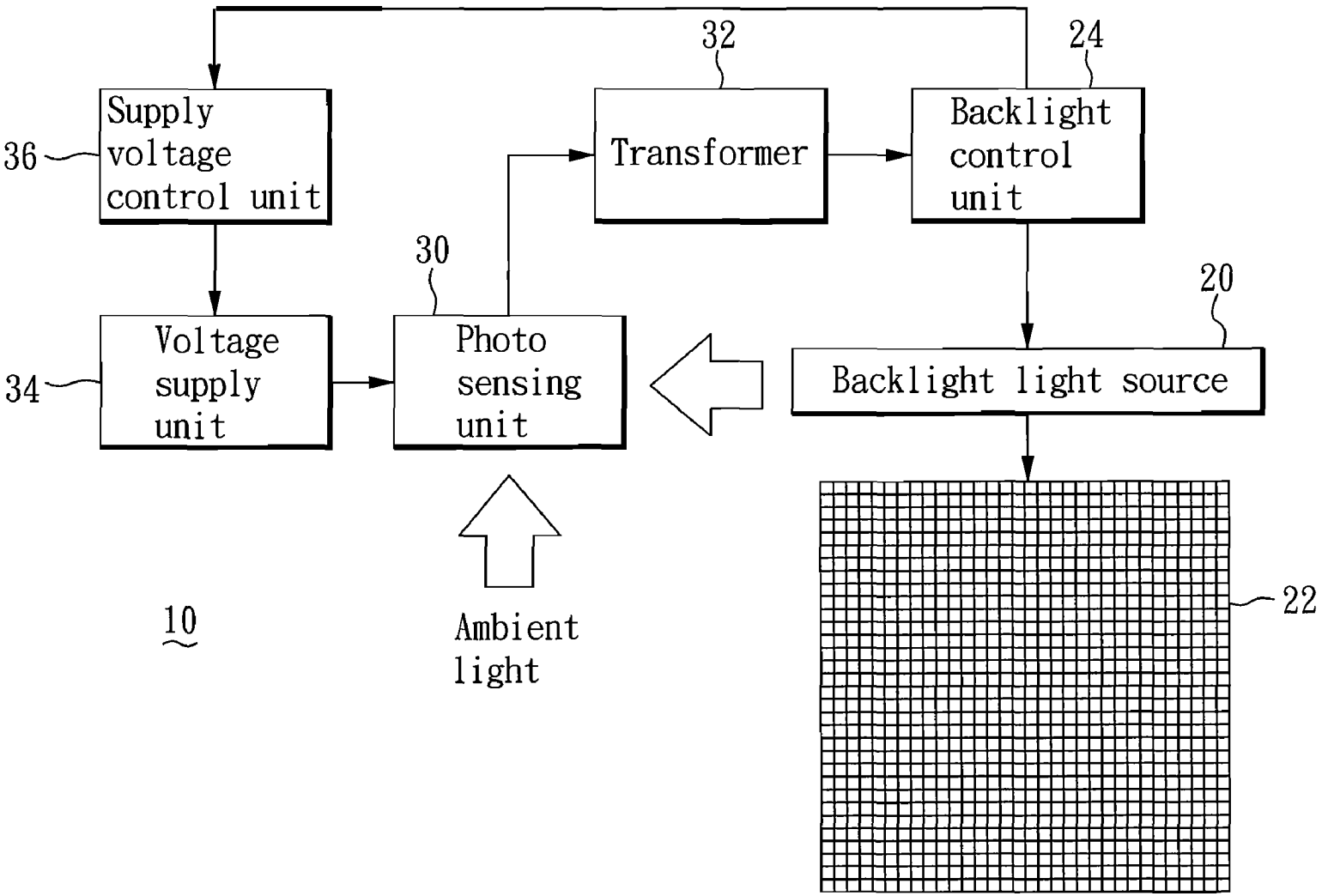
FIG. 2 is a block diagram illustrated the structure of an electronic device having the display device according to the embodiment of the invention.

FIG. 2 is a block diagram illustrated the structure of an electronic device having the display device according to the embodiment of the invention.

The display device 10 shown in FIG. 2, such as a transparent type or transflective type liquid crystal display, has a backlight light source 20, a liquid crystal display module 22 and a backlight control unit 24, wherein the plurality of pixels of liquid crystal display module 22 are positioned in the matrix manner, and the backlight light source 20 is on the back side of the liquid crystal display module 22 for illuminating on the liquid crystal pixels of the liquid crystal display module 22. Besides, the liquid crystal display module 22 uses the voltage to change the orientation direction of the liquid crystal molecules, for blocking the light from the backlight light source 20 or permitting the light from the backlight light source 20 passing through it, in order to display images. Furthermore, the backlight control unit 24 controls the operation of the backlight light source 20, for example, the backlight control unit 24 turns on or turns off the illumination of the backlight light source 20, and modulates the light intensity of the light from the backlight light source 20.

As shown in FIG. 2, the display device further has a photo sensing unit 30, a transformer 32, a voltage supply unit 34, and a supply voltage control unit 36. Similar to the aforementioned liquid crystal display module 22, the photo sensing unit 30 formed on the glass substrate is capable of detecting the light intensity of ambient light and outputting a photocurrent corresponding to the light intensity of ambient light. The transformer 32 transforms the photocurrent outputted by the photo sensing unit 30 into a voltage or digital pulse signal, and apply the voltage or digital pulse signal to the backlight control unit 24.

In the present embodiment, the transformer 32 is not absolutely required, since if the photocurrent can be input to the backlight control unit 24 directly, then the transformer 32 can be omitted. Moreover, the backlight control unit 24 can control the light intensity of the light emitted by the backlight light source 20, in response to the input voltage, digital pulse signal or photocurrent. The voltage supply unit 34 outputs a voltage, which makes the photo sensing unit 30 output a certain amount of photocurrent, to the photo sensing unit 30. The supply voltage control unit 36 controls the voltage supply unit 34 by modulating the voltage supplied to the photo sensing unit 30, based on the operation status of the backlight light source 20.

In detail, the supply voltage control unit 36 outputs a first voltage to the photo sensing unit 30, while the backlight light source 20 is operating. The supply voltage control unit 36 outputs a second voltage, which is different from the first voltage, to the photo sensing unit 30, while the backlight light source 20 is not operating. In this manner, the supply voltage control unit 36 controls the voltage supply unit 34. Besides, with the signal provided by the backlight control unit 24, the supply voltage control unit 36 is informed with the operation status of the backlight light source 20.

Figure 3A:
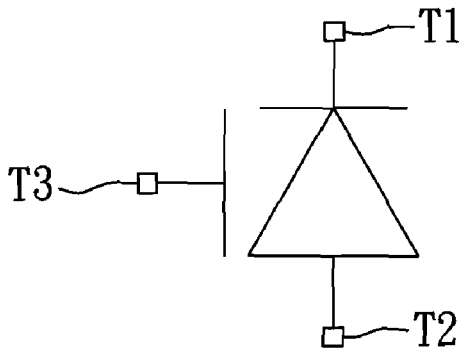
FIG. 3A illustrated the structure of the photo sensing unit, which is a three-terminal low temperature poly-silicon lateral-type PIN photodiode.
Figure 3B:
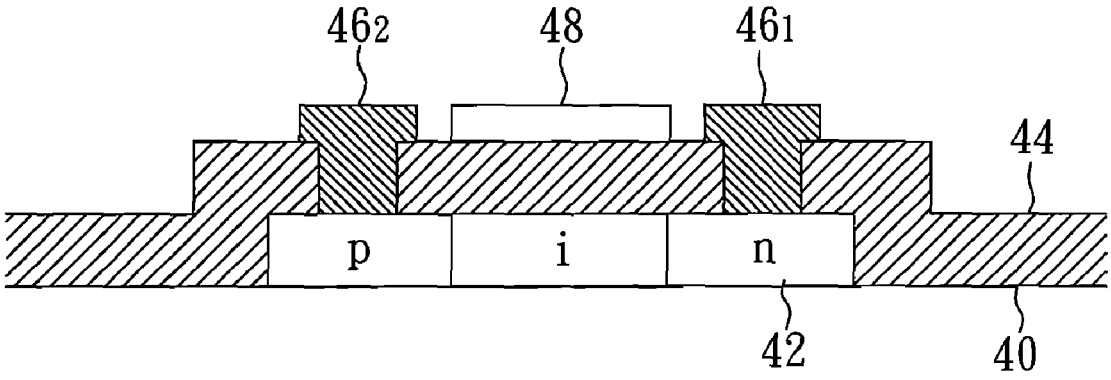
FIG. 3B is a cross-sectional view of the LTPS photodiode, which is applied as the photo sensing unit of the display device according to one embodiment of the present invention.
Figure 3C:
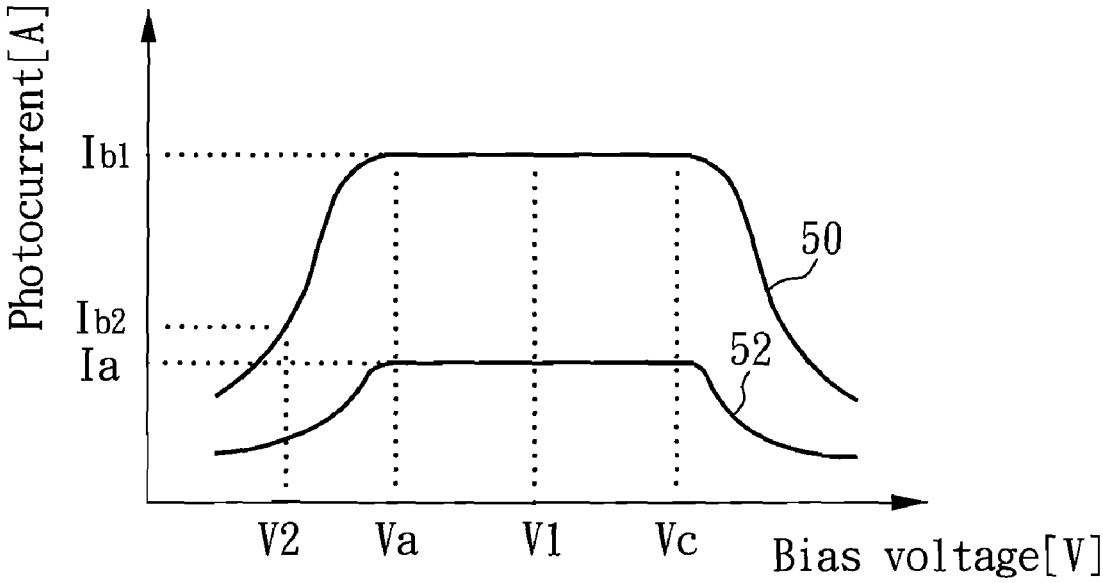
FIG. 3C illustrated the voltage-current characteristic of the LTPS photodiode, which is applied as the photo sensing unit of the display device according to one embodiment of the present invention.

FIG. 3A through FIG. 3C illustrated the structure and characteristic of the photo sensing unit of the display device according to one embodiment of the present invention.

As an explanatory example, FIG. 3A illustrated the structure of the photo sensing unit, which is a three-terminal low temperature poly-silicon lateral-type PIN photodiode (which will be described by the expression "LTPS photodiode" in the following). The LTPS photodiode includes three terminals, i.e., the cathode T1, the anode T2, and the gate electrode T3. In practical operation, a fixed current source or a fixed voltage source is connected with the anode T2. When the LTPS photodiode is illuminated with a certain light intensity, a photocurrent flows from the cathode T1 to the anode T2, wherein the amount of the photocurrent will be changed depending on the value of the voltage output to the gate electrode T3.

FIG. 3B is a cross-sectional view of the LTPS photodiode. At first, a poly-silicon 42 is formed on a portion of the glass substrate 40. The poly-silicon 42 includes a PIN structure, wherein an intrinsic semiconductor layer (i) is sandwiched between the p-type semiconductor layer (p) and the n-type semiconductor layer (n). Then, an insulator 44 is formed on the glass substrate 40 and the poly-silicon 42. Later, portions of the insulator 44 located above the p-type semiconductor layer and the n-type semiconductor layer is removed, and metal layers $\mathbf{46}_1$ and $\mathbf{46}_2$ are formed at the portions of the insulator 44 being removed. The first metal layer $\mathbf{46}_1$, which is connected with the n-type semiconductor layer, is served as the cathode T1. The second metal layer $\mathbf{46}_2$, which is connected with the p-type semiconductor layer, is served as the anode T2. Besides, a transparent electrode 48, being used as the gate electrode T3, is formed on the insulate 44 located above the intrinsic semiconductor layer. The LTPS photodiode is capable of receiving the light emitted by the backlight light source, which is coming from the lower side and passing through the glass substrate 40, while receiving the light from the upper side by the gate electrode T3.

FIG. 3C illustrated the voltage-current characteristic of the LTPS photodiode. In FIG. 3C, the lateral axis displays the value of the bias voltage output to the gate electrode T3, while the vertical axis displays the amount of the photocurrent flowing from the cathode T1 to the anode T2. Besides, the curve 50 represents the voltage-current characteristic of the LTPS photodiode while the backlight light source is operating. The curve 52 represents the voltage-current characteristic of the LTPS photodiode while the backlight light source is not operating, i.e. only the ambient light can be detected. As shown in the figure, the amount of the photocurrent is changed corresponding to the light intensity of the light illuminated on the LTPS photodiode. Besides, due to the effect from the light emitted by the backlight light source, the amount of the photocurrent is larger while the backlight light source is operating. Moreover, as described above, although the amount of the photocurrent is changed corresponding to the value of the bias voltage output to the gate electrode T3, the amount of the photocurrent is fixed at a maximum value within the range between the voltage Vc output on the cathode T1 and the voltage Va output on the anode T2 (Vc>Va).

In the conventional display device, the photocurrent is always fixed at the maximum value regardless of the operation status of the backlight light source. Besides, a voltage V1 within the range between Vc and Va is output to the photo sensing unit. Moreover, as the voltage V1 is being output to the photo sensing unit, the LTPS photodiode outputs a photocurrent $Ib_1$ if the backlight light source is operating, and outputs a photocurrent Ia if the backlight light source is not operating ($Ib_1$>Ia).

The display device according to one embodiment of the present invention applies the supply voltage control unit 36, which modulates the value of the bias voltage output to the photo sensing unit within the range between a first voltage and a second voltage, corresponding to the operation status of the backlight light source. In detail, as the backlight light source is operating, the supply voltage control unit 36 outputs a voltage V2 outside the range between Vc and Va to the photo sensing unit. As shown in FIG. 3C, the photocurrent $Ib_2$ outputs from the photo sensing unit is smaller than the maximum photocurrent $Ib_1$ when the backlight light source is operating. As the backlight light source is not operating, the supply voltage control unit 36 outputs a voltage V1 within the range between Vc and Va to the photo sensing unit. At this time, the photocurrent Ia output from the photo sensing unit is equal to the maximum photocurrent while the backlight light source is not operating.

Figure 4:
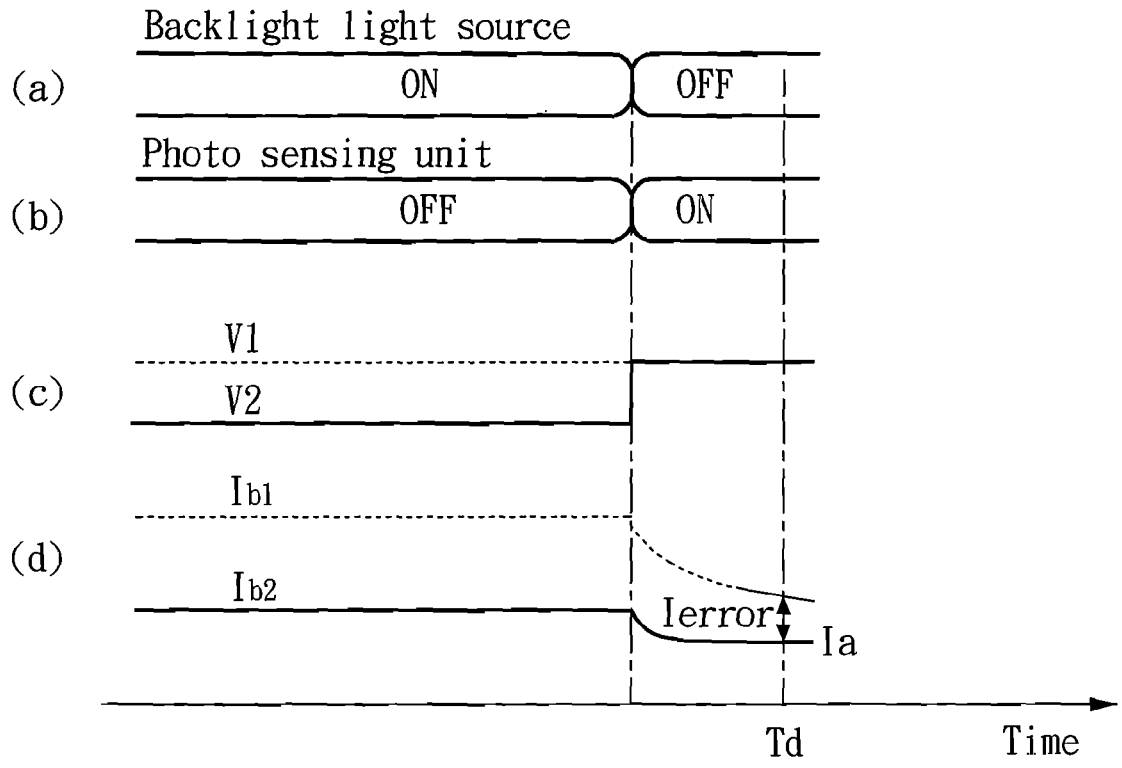
FIG. 4 displays the operation of the display device according to one embodiment of the present invention, which applies the LTPS photodiode of FIG. 3 as its photo sensing unit.

FIG. 4 illustrated the timing chart of the operation of the display device according to the embodiment of the invention, which applies the LTPS photodiode of FIG. 3 as its photo sensing unit.

FIG. 4(*a*) displays the operation of the backlight light source 20, while FIG. 4(*b*) displays the operation of the photo sensing unit of the display device. As shown in FIG. 4(*a*) and FIG. 4(*b*), in order to obviate the effect caused by the light emitted by the backlight light source 20, the display device will cut off the illumination of the light emitted by the backlight light source 20 with the usage of the backlight control unit 24, i.e. putting the backlight light source in a non-operating status, for the display device to detect the light intensity of ambient light and modulate the light intensity of the light emitted by the backlight light source 20 based on the results of the detection.

FIG. 4(*c*) displays the bias voltage, which the voltage supply unit 34 outputs to the gate electrode T3 of the LTPS photodiode functioning as the photo sensing unit 30. The dash-line in the figure displays the bias voltage of a conventional display device, while the solid-line in the figure displays the bias voltage of the display device according to one embodiment of the present invention.

FIG. 4(*d*) displays the photocurrent output by the photo sensing unit 30, i.e. the current flowing from the cathode T1 of the LTPS photodiode to the anode T2 of the LTPS photodiode. The dash-line in the figure displays the photocurrent of a conventional display device, while the solid-line in the figure displays the photocurrent of the display device according to one embodiment of the present invention.

That is, a voltage V1 (within the range between Vc and Va) is output to the photo sensing unit 30, which makes the photocurrent be fixed at a certain value regardless of the operation status of the backlight light source. At this time, the photo sensing unit 30 outputs a photocurrent $Ib_1$, while the backlight light source is operating. Then, theoretically speaking, once the backlight light source switches from the "operating status" to the "non-operating status", the photo sensing unit 30 should detect the light intensity ambient light only, having the voltage-current characteristic displayed by the curve 52 of FIG. 3C, and output the photocurrent Ia. But, in practical operation, the photocurrent cannot switch from $Ib_1$ to Ia immediately; it needs a period of time to complete the switching process. As a result, an error Ierror exists in the photocurrent detection result, which is obtained at the detection time slot Td, as shown in FIG. 4(*d*). Therefore, even though the backlight light source has been turned off for obviating the effect from the light emitted by the backlight light source, but as the light intensity of the light emitted by the backlight light source is much larger than that of ambient light, the detection result from the photo sensing unit is still affected by the light emitted by the backlight light source.

The display device according to one embodiment of the present invention applies the supply voltage control unit 36 to provide a bias voltage (within the range between the first voltage and the second voltage) to the photo current unit 30 based on the operation status of the backlight light source 20. In detail, as the backlight light source is operating, the supply voltage control unit 36 outputs a voltage V2 outside the range between Vc and Va to the photo sensing unit 30, which makes the photo sensing unit 30 output a maximum photocurrent $Ib_1$. Therefore, the photo sensing unit 30 can output a photocurrent $Ib_2$, which is smaller than the maximum photocurrent $Ib_1$. Later, once the backlight light source switches into the "non-operating status", the supply voltage control unit 36 controls the voltage supply unit 34 to change the bias voltage output to the photo sensing unit 30 from the voltage V2 into a voltage V1 within the range between Vc and Va. By doing this, once the backlight light source switches into the "non-operating status", the photo sensing unit 30 can output the maximum photocurrent Ia immediately. However, in practical operation, it still takes a moment to switch the output current from $Ib_2$ to Ia. Nevertheless, since the difference between the $Ib_2$ and Ia is smaller than the difference between $Ib_1$ and Ia, it will take a shorter period of time to complete the switching process in the display device according to one embodiment of the present invention. As a result, the error Ierror existing in the photocurrent detection result, which is obtained at the detection time slot Td, can be decreased, even be removed completely.

In this manner, the display device according to one embodiment of the present invention can detect the light intensity of ambient light with higher accuracy by the way of changing the voltage which makes the photo sensing unit output a certain amount of photocurrent.

It should be noticed that only the best mode of the present invention has been disclosed above, but the scope of the present invention in not thus limited to the best mode. The scope of the present invention can also be varied without deviating from the spirit of the present invention.

For example, even though a three terminal LTPS photodiode is used as the photo sensing current, a two terminal amorphous silicon diode (without any gate electrode) can also be used in the display device of the present invention. At this example, the voltage between the cathode and the anode of the amorphous silicon diode can be changed corresponding to the operation status of the backlight light source. Thus, the detection error caused by the backlight light source can be decreased, and even be removed completely.

Moreover, even though the voltage output to the photo sensing unit is changed in a two-step manner, the characteristic of the element of the photo sensing unit and the operation status, such as the type of the electronic machine having the display device or the number of the light source is more than one, the voltage output to the photo sensing unit can also be changed in a three-step manner or in more than three steps.

What is claimed is:

1. A display device, comprising:

a backlight light source;

a photo sensing unit capable of detecting the light intensity of ambient light and outputting a photocurrent corresponding to the light intensity of the ambient light;

a voltage supply unit, for providing a voltage, which makes the photo sensing unit output a certain amount of photocurrent, to the photo sensing unit; and a supply voltage control unit, for controlling the voltage supply unit by the way of modulating the voltage supplied to the photo sensing unit based on the operation status of the backlight light source;

wherein the supply voltage control unit outputs a voltage of a first voltage to the photo sensing unit while the backlight light source is operating; and the supply voltage control unit outputs a voltage of a second voltage, which is different from the first voltage, to the photo sensing unit while the backlight light source is not operating, and wherein the voltage of the second voltage makes the photo sensing unit output a photocurrent with maximum value, and the voltage of the first voltage makes the photo sensing unit output a photocurrent with the value smaller than the maximum value.

2. The display device as claimed in claim 1, wherein the photo sensing unit is a low-temperature poly-silicon lateral-type PIN photodiode or an amorphous diode.

3. A transparent type or transflective type liquid crystal display, comprising the display device as claimed in claim 1.

4. An electronic device, comprising the display device as claimed in claim 1.

5. The display device as in claim 1, wherein the second voltage is of a non-zero value.

6. A display device, comprising:

a backlight light source;

a photo sensing unit detecting light intensity and outputting a photocurrent corresponding to detected light intensity;

a biasing voltage supply providing a bias voltage to the photo sensing unit to output photocurrent to the photo sensing unit based on the operation status of the backlight light source, wherein the biasing voltage supply provides a first bias voltage to the photo sensing unit while the backlight light source is operating, and the biasing voltage supply unit provides a second bias voltage to the photo sensing unit while the backlight light source is not operating, and wherein the second bias voltage is of a non-zero value and different from the first bias voltage.

7. The display device as claimed in claim 6, wherein the photo sensing unit has a first voltage-current characteristic with a first maximum photocurrent output value with respect to applied bias voltage, and a second voltage-current characteristic with a second maximum photocurrent output value with respect to applied bias voltage.

8. The display device as claimed in claim 7, wherein the second maximum photocurrent output value is less than the first maximum photocurrent output value.

9. The display device as claimed in claim 7, wherein the first bias voltage is provided to the photo sensing unit to output photocurrent at a first photocurrent value less than the first maximum photocurrent output value while the backlight source is operating, and the second bias voltage is provided to the photo sensing unit to output photocurrent at a second photocurrent value at the second maximum photocurrent output value while the backlight source is not operating.

10. The display device as claimed in claim 9, wherein a difference between the first photocurrent value and the second maximum photocurrent output value is less than a difference between the first maximum photocurrent output value and the second maximum photocurrent output value.

11. The display device as claimed in claim 10, wherein the second maximum photocurrent output value is less than the first maximum photocurrent output value.

12. The display device as claimed in claim 6, wherein the biasing voltage supply comprises a supply voltage control unit that controls a supply voltage control unit to provide the first bias voltage or the second bias to the photo sensing unit depending on the operation status of the backlight source.

13. The display device as claimed in claim 6 wherein the photo sensing unit is a low-temperature poly-silicon lateral-type PIN photodiode or an amorphous diode.

14. A transparent type or transflective type liquid crystal display, comprising the display device as claimed in claim 6.

15. An electronic device, comprising the display device as claimed in claim 6.

16. A display device, comprising:

a backlight light source;

a photo sensing unit detecting light intensity and outputting a photocurrent corresponding to detected light intensity;

a biasing voltage supply providing a bias voltage to the photo sensing unit to output photocurrent to the photo sensing unit based on the operation status of the backlight light source, wherein the biasing voltage supply provides a first bias voltage to the photo sensing unit while the backlight light source is operating, and the biasing voltage supply unit provides a second bias voltage to the photo sensing unit while the backlight light source is not operating, and wherein the second bias voltage is different from the first bias voltage, wherein the photo sensing unit has a first voltage-current characteristic with a first maximum photocurrent output value with respect to applied bias voltage, and a second voltage-current characteristic with a second maximum photocurrent output value with respect to applied bias voltage, and wherein the first bias voltage is provided to the photo sensing unit to output photocurrent at a first photocurrent value less than the first maximum photocurrent output value while the backlight source is operating, and the second bias voltage is provided to the photo sensing unit to output photocurrent at a second photocurrent value at the second maximum photocurrent output value while the backlight source is not operating.

17. The display device as claimed in claim 16, wherein a difference between the first photocurrent value and the second maximum photocurrent output value is less than a difference between the first maximum photocurrent output value and the second maximum photocurrent output value.

18. The display device as claimed in claim 17, wherein the second maximum photocurrent output value is less than the first maximum photocurrent output value.

19. The display device as claimed in claim 16, wherein the biasing voltage supply comprises a supply voltage control unit that controls a supply voltage control unit to provide the first bias voltage or the second bias to the photo sensing unit depending on the operation status of the backlight source.

20. The display device as in claim 16, wherein the second bias voltage is of a non-zero value.

* * * * *